US007946350B2

(12) United States Patent
Greenaway

(10) Patent No.: US 7,946,350 B2
(45) Date of Patent: May 24, 2011

(54) SYSTEM AND METHOD FOR DEPLOYING OPTICAL FIBER

(75) Inventor: Robert Greenaway, Frimley (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 366 days.

(21) Appl. No.: 12/136,567

(22) Filed: Jun. 10, 2008

(65) Prior Publication Data

US 2009/0266562 A1 Oct. 29, 2009

Related U.S. Application Data

(60) Provisional application No. 61/047,303, filed on Apr. 23, 2008.

(51) Int. Cl.
*E21B 23/08* (2006.01)
*E21B 47/01* (2006.01)

(52) U.S. Cl. ..... 166/385; 166/241.1

(58) Field of Classification Search ..... 166/385, 166/67, 113, 241.1, 241.6, 242.3, 242.6
See application file for complete search history.

(56) References Cited

U.S. PATENT DOCUMENTS

| | | | | |
|---|---|---|---|---|
| RE37,283 | E * | 7/2001 | Kluth et al. | 385/12 |
| 7,152,685 | B2 | 12/2006 | Adnan et al. | |
| 7,240,730 | B2 | 7/2007 | Williams et al. | |
| 7,254,289 | B2 | 8/2007 | Wait et al. | |
| 2005/0149264 | A1 | 7/2005 | Tarvin et al. | |
| 2005/0236161 | A1 * | 10/2005 | Gay et al. | 166/380 |
| 2005/0281511 | A1 * | 12/2005 | Ringgenberg et al. | 385/70 |
| 2006/0153508 | A1 | 7/2006 | Bowker et al. | |
| 2007/0126594 | A1 | 6/2007 | Atkinson et al. | |

FOREIGN PATENT DOCUMENTS

| | | | |
|---|---|---|---|
| EP | 0820787 | A2 | 4/1999 |
| GB | 2325308 | A | 11/1998 |
| WO | 2004005968 | A2 | 1/2004 |
| WO | 2004029411 | A1 | 4/2004 |
| WO | 2005103437 | A1 | 11/2005 |
| WO | 2005116388 | A1 | 12/2005 |
| WO | 2007039836 | A2 | 4/2007 |
| WO | 2007113753 | A2 | 10/2007 |
| WO | 2007131662 | A1 | 11/2007 |
| WO | 2009085044 | A1 | 7/2009 |

* cited by examiner

*Primary Examiner* — David J Bagnell
*Assistant Examiner* — David Andrews
(74) *Attorney, Agent, or Firm* — Brandon S. Clark; Rodney V. Warfford

(57) ABSTRACT

A technique is provided for utilizing optical fiber in a well environment. A well system is combined with a tube-in-tube system designed to protect one or more internal optical fibers. The tube-in-tube system has an entry at one end and a turn around at an opposite end to enable fluid flow between a flow passage within an inner tube and a flow passage within an annulus between the inner tube and a surrounding outer tube. An optical fiber is deployed in and protected by the tube-in-tube system.

9 Claims, 5 Drawing Sheets

SYSTEM AND METHOD FOR DEPLOYING OPTICAL FIBER

RELATED APPLICATIONS

This application claims the benefit of U.S. Provisional Application No. 61/047,303, filed Apr. 23, 2008, the contents of which are herein incorporated by reference.

BACKGROUND

Optical fibers are used for carrying signals in a variety of applications, including telephony applications. The optical fibers are installed into ducting by "blowing" the fiber through the ducting. Generally, the ducting is open on both ends to allow the fiber to be blown through the entire duct. In some well related applications, fluid drag forces also have been used to install fibers into individual control lines. However, well applications can create difficulties in deploying and retrieving optical fiber.

SUMMARY

In general, the present invention provides a system and method for utilizing optical fiber in a well environment. A well system is combined with a tube-in-tube system designed to protect one or more internal optical fibers. The tube-in-tube system has an entry at one end and a turn around at an opposite end to enable fluid flow between a flow passage within an inner tube and a flow passage created in the space between the inner tube and a surrounding outer tube. An optical fiber is deployed in and protected by the tube-in-tube system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for utilizing and protecting optical fibers in a variety of well related applications. For example, a tube-in-tube technology enables fiber optic deployment and replacement via fluid pumping. The use of the tube-in-tube technology provides a single tubular form that reduces the number of hardware penetrations in many applications while providing greater protection to the optical fiber.

The technique can be used in well related applications with many types of equipment. For example, the fiber optic protection system can be used in combination with various tubular well components, including wellbores, well completions, pipelines, flowlines, risers and other well related equipment. Additionally, the unique design enables deployment and retrieval of a fiber optic line when access is only available at one end of the system. In many applications, the fiber optic line can be deployed and/or retrieved via the use of fluid that may be pumped to create fluid drag forces. Similarly, an inner tube of the tube-in-tube arrangement can be deployed and/or retrieved via fluid drag forces in at least some well related applications. The optical fibers can be deployed independently, in groups, and/or as pre-fabricated cable.

With respect to protection, the tube-in-tube technique not only provides physical protection but also provides multiple barriers against the influx of hydrogen. Hydrogen can attack and cause deterioration of fiber optic lines, but the dual walls of the tube-in-tube technology help block the hydrogen. Additionally, fluid can be circulated through the tube-in-tube structure to expel unwanted gases, e.g. hydrogen gases, which could otherwise degrade the internal fiber optic line.

Figure 1:
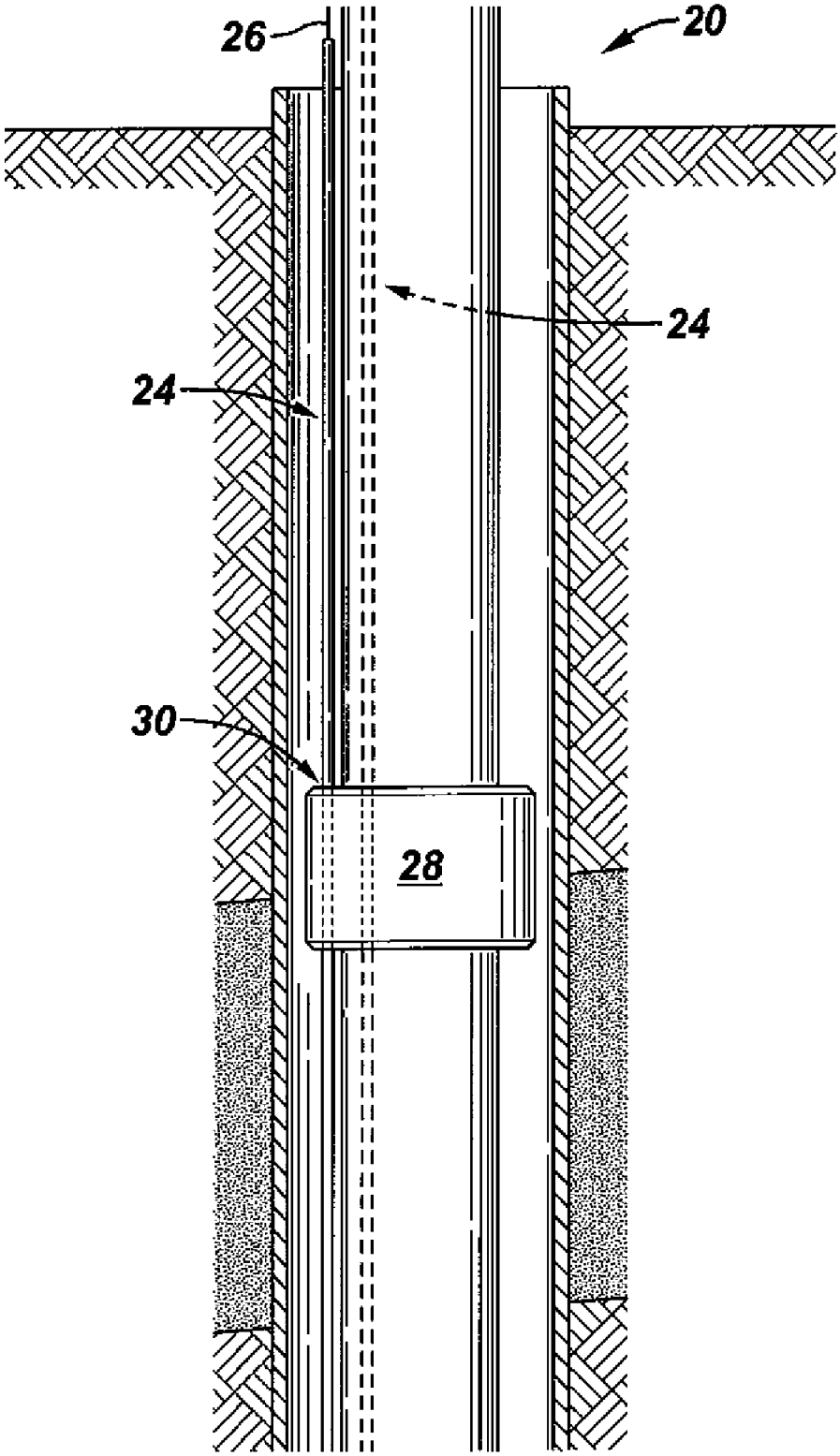
FIG. 1 is a schematic illustration of a well related system having a fiber optic system, according to an embodiment of the present invention.

Referring generally to FIG. 1, a well system 20 is illustrated according to one embodiment of the present invention. In this embodiment, well system 20 comprises a tubular well component 22 and a fiber optic line protection system 24 for protecting one or more fiber optic lines 26 which may comprise optical fibers and/or optical fiber cable. In this example, the protection system 24 comprises a tube-in-tube system that provides a plurality of fluid flow paths as well as providing fiber optic line protection against physical damage and deleterious fluids. Well system 20 also may comprise other well related hardware 28, and the design of protection system 24 enables passage through hardware 28 with a single penetration 30.

Tubular well component 22 may comprise a variety of well related components, depending on the specific application utilizing fiber optic line 26. For example, tubular well component 22 may comprise a well completion, a wellbore tubular, a pipeline, a flowline, a riser, or another type of well related component. The tube-in-tube protection system 24 can be positioned along tubular well component 22 in a variety of ways depending on the application. For example, system 24 can be deployed across a well completion, behind a well completion, across one or more subterranean reservoirs, or as a free hanging member from a surface exit of a well. In other embodiments, system 24 can be deployed along an exterior, inside, or across a pipeline, flowline or riser. As illustrated in FIG. 1, for example, the protection system 24 is deployed along the exterior of tubular well component 22. However, the protection system 24 also can be deployed within tubular well component 22, as indicated by dashed lines.

Figure 2:
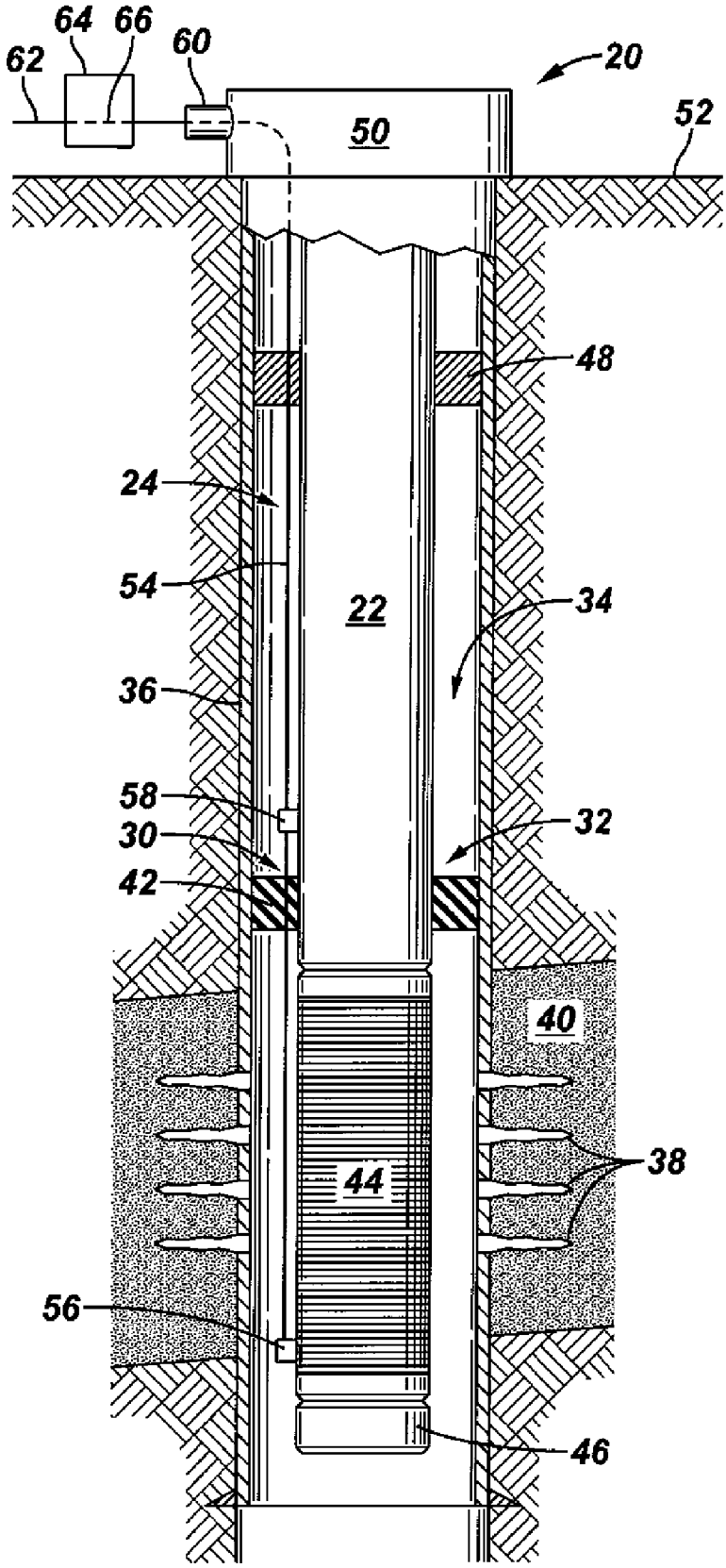
FIG. 2 is a front elevation view of a specific example of a well system deployed in a wellbore with the fiber optic system, according to an embodiment of the present invention.

In FIG. 2, one example of well system 20 is illustrated as constructed for use in a wellbore environment. In this example, tubular well component 22 comprises a tubing string having a well completion 32 deployed in a wellbore 34. In some embodiments, wellbore 34 is lined with a wellbore casing 36 having perforations 38 that allow communication between wellbore 34 and a surrounding formation 40.

Although well completion 32 may be constructed with a variety of components and configurations, the illustrated embodiment is provided as an example and comprises a packer 42, a perforated tubing section 44, and a tubing bullnose 46. The perforated tubing section 44 enables communication between wellbore 34 and an interior of well completion 32. In the embodiment illustrated, protection system 24 comprises a tube-in-tube system that extends through packer 42 via single penetration 30. The overall well system 20 also may comprise a variety of components and configurations, including, for example, a hangar 48 and a well head 50. In this example, tubular well component 22 is suspended by hangar 48 and extends downwardly into wellbore 34 from well head 50. Well head 50 may be positioned at a surface location 52.

Similarly, protection system 24 may comprise a variety of components and may be arranged in various configurations. In the embodiment illustrated, protection system 24 comprises tubes or conduits 54 that extend downwardly along tubular well component 22 to a fluid turn around 56. The system 24 also may comprise one or more splices 58 for splicing sections of tubing together while maintaining the pressure integrity of the tubing 54. In the example illustrated, tubing 54 encloses fiber optic line 26 and is routed through both packer 42, via single penetration 30, and through hangar 48 via another single penetration 30. The tubing 54 and enclosed fiber optic line pass through well head 50 and out through a well head outlet 60. Outside of well head 50, the fiber optic line 26 can be joined with a surface cable 62 in a junction box 64 via a junction 66. The junction box 64 also may comprise pressure seals used to seal the fiber optic line 26 to the tubing 54 containing the fiber optic line.

Figure 3:
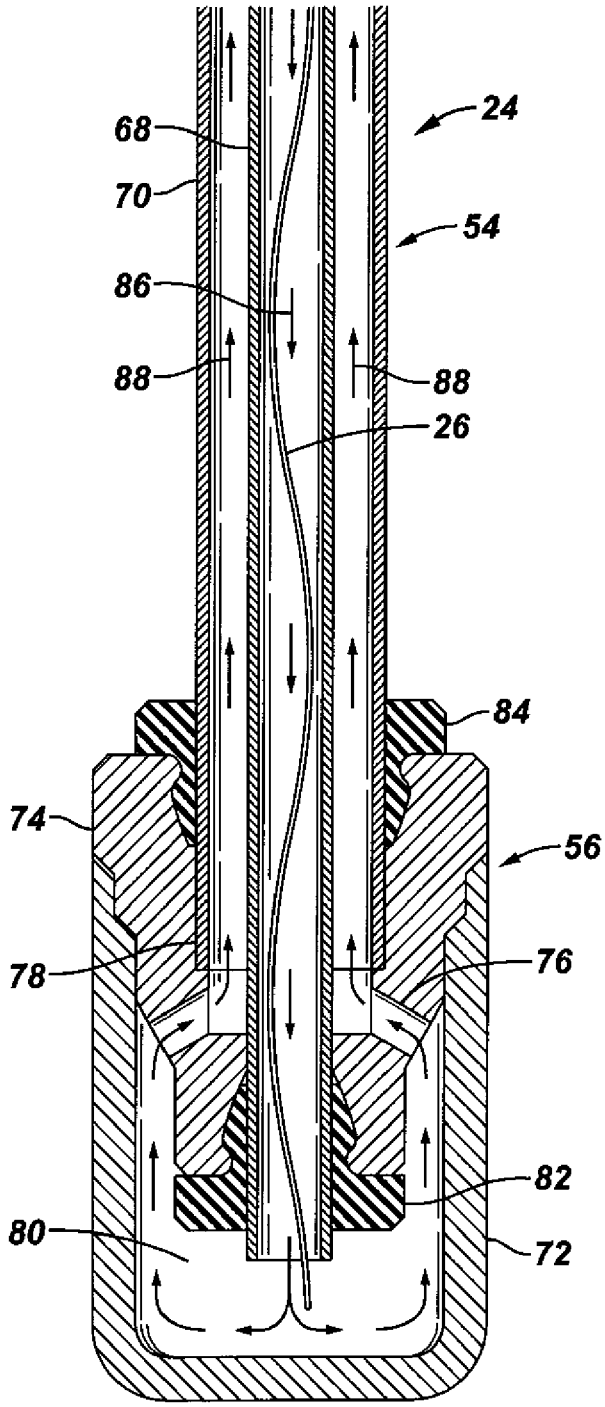
FIG. 3 is a view of one example of a turn around used in the fiber optic system illustrated in FIG. 1, according to an embodiment of the present invention.
Figure 4:
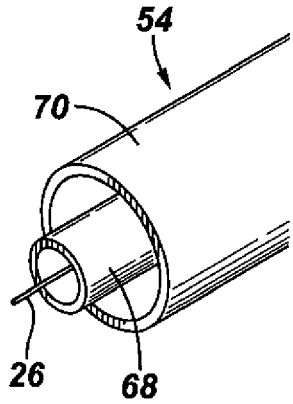
FIG. 4 is a partial, orthogonal view of one example of a tube-in-tube arrangement used in the fiber optic system illustrated in FIG. 1, according to an embodiment of the present invention.

In FIG. 3, one example of fluid turn around 56 is illustrated. Fluid turn around 56 is connected to a distal end of tubing 54 and is used to sealingly lock together an inner tube 68 and an outer tube 70. (See also FIG. 4). The fluid turn around 56 anchors the inner tube 68 and the outer tube 70 at one end while allowing fluid flow between the inner tube and the outer tube. The fluid turn around 56 also is designed to maintain pressure integrity with respect to the surrounding environment.

As illustrated in FIG. 3, one embodiment of fluid turn around 56 comprises an outer housing 72 connected and sealed to an inner structure 74 having crossover flow passages 76. Inner structure 74 also comprises a recessed portion 78 sized to receive outer tube 70, as illustrated. Inner tube 68 extends through structure 74 into fluid communication with a cavity 80 formed between outer housing 72 and inner structure 74. The inner structure 74 is sealed against inner tube 68 by a seal member 82 on one side of crossover flow passages 76, and inner structure 74 is sealed against outer tube 70 by a seal member 84 on an opposite side of passages 76. Seal members 82, 84 may be elastomeric or may be metallic, e.g. metallic ferrules, to form metal-to-metal seals.

Because fluid turn around 56 is sealed with respect to inner tube 68 and outer tube 70, fluid can be flowed along flow passages within inner tube 68 and within outer tube 70 without being affected by surrounding fluid. For example, fluid can be flowed down through inner tube 68 along an inner tube flow passage, as represented by arrows 86. The fluid is discharged from inner tube 68 into cavity 80 and directed upwardly through crossover flow passages 76 and into an outer tube flow passage, as represented by arrows 88. The fluid can then be returned to, for example, a surface location. In the embodiment illustrated, the outer tube flow passage, represented by arrows 88, comprises an annulus formed between inner tube 68 and outer tube 70.

The flow of fluid down through inner tube 68 can be used to deploy fiber optic line 26, e.g. an optical fiber, as illustrated. The flowing fluid carries or drags the fiber optic line down through inner tube 68. Retrieval of the fiber optic line 26 can be achieved simply by reversing the direction of flow and flowing fluid down through outer tube 70 along flow passage 88, out through crossover flow passages 76, through cavity 80, and up through inner tube flow passage 86. It should be noted that in other applications, the flow of fluid along passages 86, 88 can be used to deploy fiber optic line into the annulus between inner tube 68 and outer tube 70. In some applications, the fiber optic line may be deployed along both inner tube flow passage 86 and outer tube flow passage 88 as a single optical fiber loop or as separate optical fibers.

Figure 5:
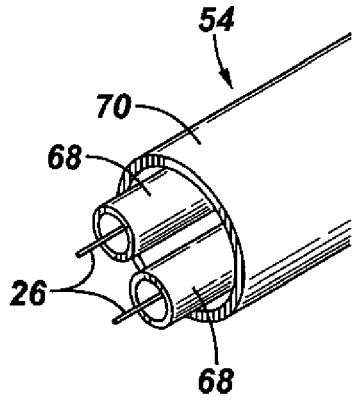
FIG. 5 is a partial, orthogonal view of another example of a tube-in-tube arrangement used in the fiber optic system illustrated in FIG. 1, according to an alternate embodiment of the present invention.

Referring again to FIG. 4, tubing 54 may be formed in various configurations depending on the specific well application. In the embodiment illustrated, for example, the single inner tube 68 is deployed within the outer tube 70, and fiber optic line 26 is protected within the inner tube 68. In alternate embodiments, the inner tube 68 may protect a plurality of fiber optic lines 26, or a plurality of inner tubes 68 can be used to protect a plurality of fiber optic lines 26, as illustrated in FIG. 5. Additional or alternate fiber optic lines also can be routed along the space between the one or more inner tubes 68 and the surrounding outer tube 70. In many applications, outer tube 70 and inner tube 68 are relatively small in diameter. By way of example, outer tube 70 may be constructed with a diameter of about 1 inch or less and often 0.25 inch or less, and inner tube 68 may be constructed with a diameter of 0.125 inch or less. The size of the inner tube 68 allows deployment of the inner tube 68 within outer tube 70 via fluid drag forces, at least in some applications.

Figure 6:
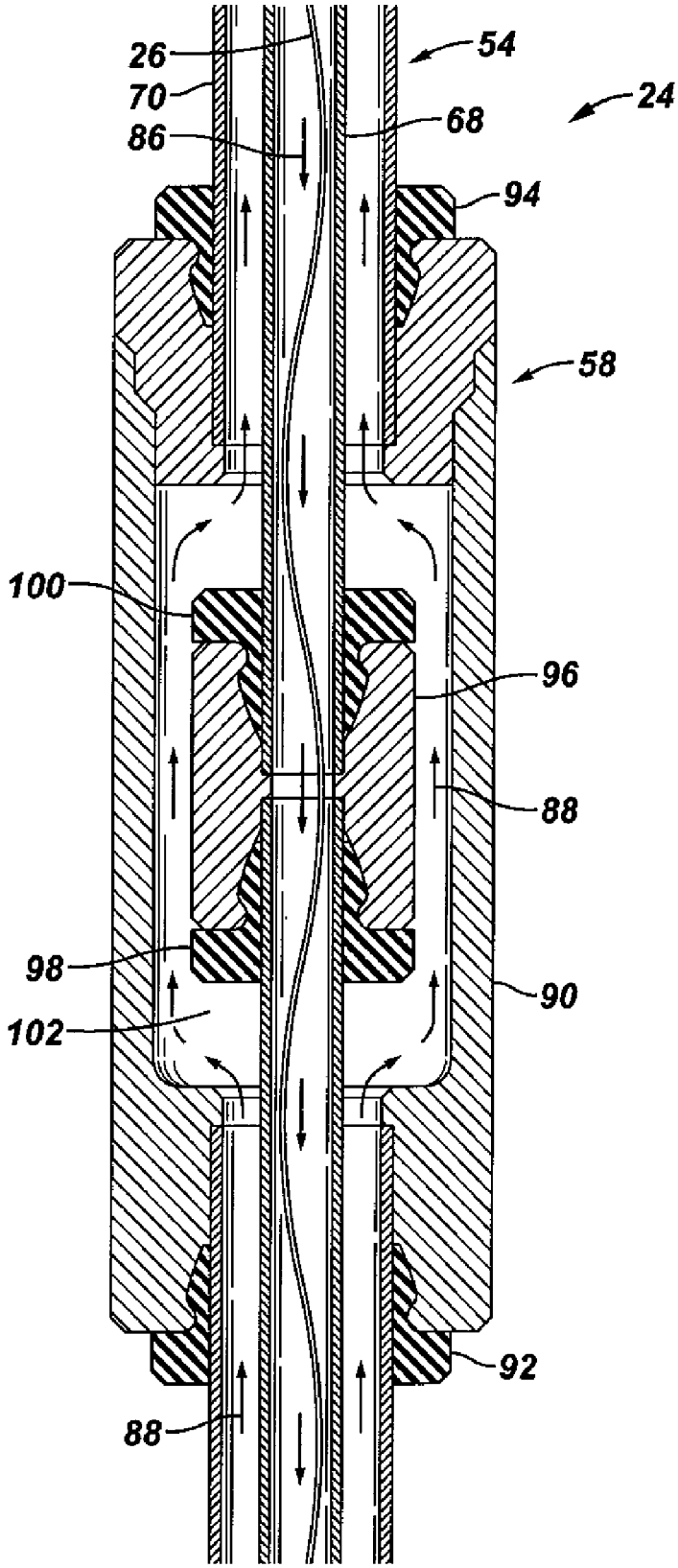
FIG. 6 is a view of one example of a splice that can be used in the fiber optic system, according to an embodiment of the present invention.

In FIG. 6, one embodiment of splice 58 is illustrated. In this embodiment, splice 58 is used to splice sections of inner tube 68 and sections of outer tube 70. The splice is formed in a sealed manner to prevent commingling of the fluid flowing along flow passages 86 and 88 with each other or with the surrounding environmental fluid. Splice 58 can be formed with a variety of components and configurations depending on the well environment and the configuration of overall protection system 24.

As illustrated, splice 58 comprises an outer housing 90 that is sealingly engaged with sections of outer tube 70 via seal members 92 and 94. An inner splice structure 96 is used to sealingly engage sections of inner tube 68 via a lower seal member 98 and an upper seal member 100. Seal members 92, 94, 98, 100 may be elastomeric or may be metallic, e.g. metallic ferrules, to form metal-to-metal seals. Inner splice structure 96 is sized to fit within an internal cavity 102 of outer housing 90 in a manner that allows fluid flow past inner splice structure 96 between the inner splice structure and the surrounding outer housing 90. Fluid flow along inner tube flow passage 86 can freely move through the sections of inner tube 68 and through inner splice structure 96. The flow along outer tube flow passage 88 can freely move within outer tube 70 along the exterior of inner tube 68 and through splice 58 via the internal cavity 102 formed between inner splice structure 96 and outer housing 90. The splice 58 enables sections of tubes 68, 70 to be connected and anchored in place while maintaining pressure integrity with respect to each fluid flow path.

Figure 7:
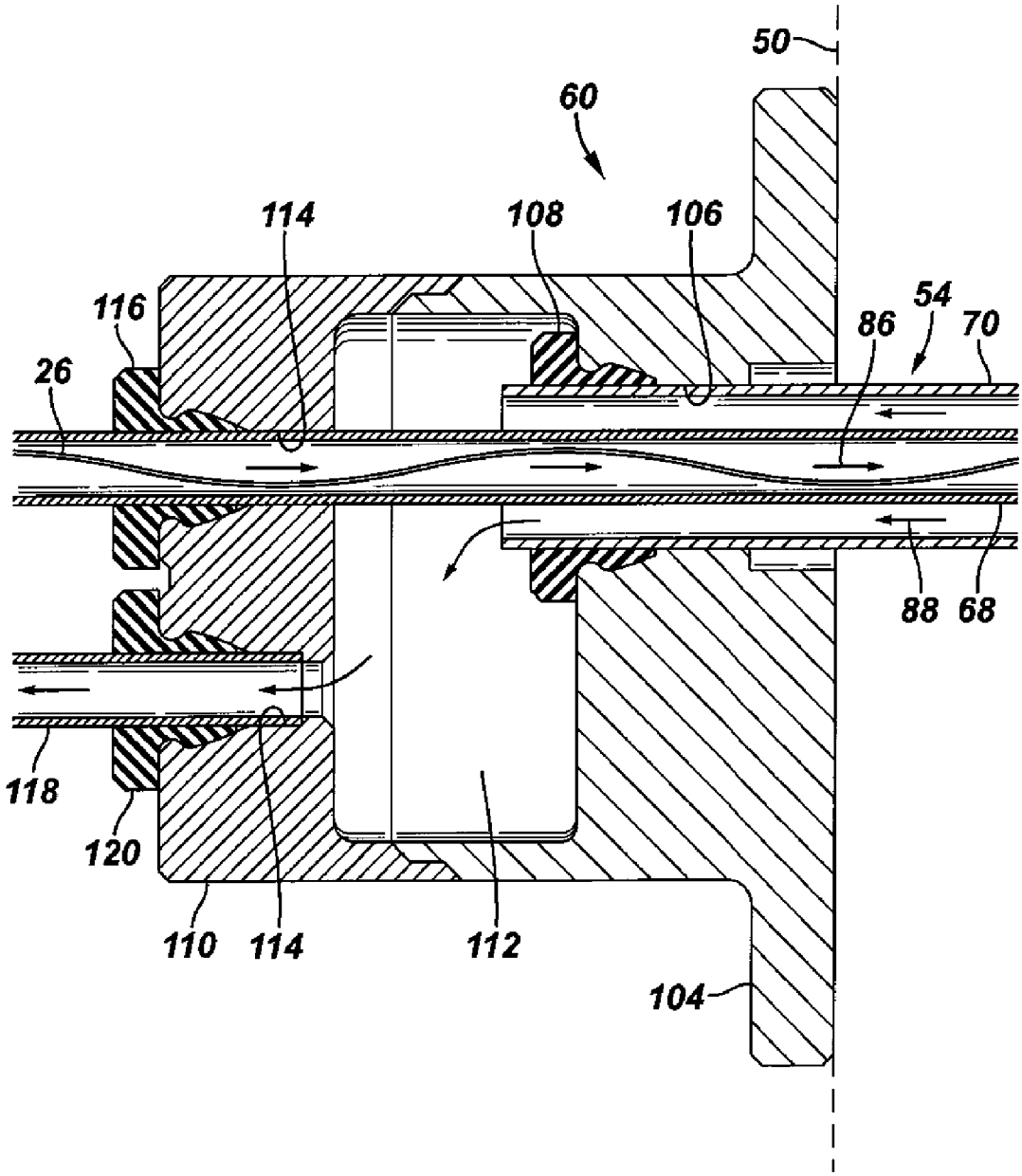
FIG. 7 is a view of one example of a well head outlet that can be used in the well system illustrated in FIG. 2, according to an embodiment of the present invention.

Referring generally to FIG. 7, one example of well head 50 and well head outlet 60 is illustrated. The well head outlet 60 enables tubes 68 and 70 to pass through the well head 50 while maintaining the pressure integrity of the well. The outlet 60 also enables separation of each flow passage, e.g. flow passage 86 or 88, from an individual tube into multiple flow access points while anchoring the flow tubes 68 and 70 in place. The well head outlet 60 also can be used to isolate each tube 68, 70 separately and, in some applications, to provide a pressure seal with respect to the fiber optic line 26 once the fiber optic line is installed.

In the illustrated embodiment, well head outlet 60 comprises a flange 104 by which the well head outlet 60 is connected to the main structure of well head 50. The flange 104 comprises a passage 106 sized to receive outer tube 70 and to form a seal with outer tube 70 via a seal member 108. The well head outlet 60 further comprises an exterior housing 110 that is joined with flange 104 to form a cavity 112. Outer tube 70 is in fluid communication with cavity 112 and either discharges fluid into cavity 112 or receives fluid from cavity 112.

Housing 110 further comprises a plurality of passages 114 for receiving tubing through which fluid flow is conducted. For example, inner tube 68 may extend through one of the passages 114 while being sealed to housing 110 via a seal member 116. Another passage 114 may receive a tubing 118 sealed to housing 110 via a seal member 120. In the illustrated embodiment, cavity 112 provides a fluid link between tubing 118 and outer tube 70. Accordingly, fiber optic line 26 can be flowed into inner tube 68 through well head outlet 60 and through protection system 24. The returning fluid can be routed along the outer tube flow passage 88, out through cavity 112, and through tubing 118. Retrieval of fiber opic line 26 can be achieved by reversing the direction of fluid flow.

The structure, size, and component configuration selected to construct fluid turn around 56, splice 58, and well head outlet 60 can vary from one application to another. Similarly, the overall configuration of protection system 24 can change and be adapted according to the environment and types of well systems with which it is utilized. Regardless of the specific form, however, the protection system 24 is designed to provide simple hydraulic connections that allow rapid make-up, and to require no fiber splices during rig time. The tube-in-tube structure provides a compact solution in which one main conduit or outer tube is employed so as to have a minimal effect on hardware installation. For example, only a single feed through port is required at completion hardware such as packer 42.

Use of the tube-in-tube structure also allows fiber optic line 26 to be deployed or removed without requiring a work over rig. The optical fibers or fiber optic cable is simply deployed and retrieved by fluid flow in a first direction or a reverse direction. Fluid flow induced deployment and retrieval enables use of a continuous line of optical fiber from a surface location to a distal end of the protection system. Accordingly, the potential for signal losses and for breakage is reduced by avoiding fiber splices. Neutral fluids also can be used to purge inner tube 68 and outer tube 70, thereby extending the life of the optical fibers.

The tube-in-tube structure not only provides physical protection but it also protects the fiber optic line 26 by providing an additional hydrogen barrier. The additional hydrogen barrier slows the rate at which hydrogen migrates to the fiber optic line, thus prolonging the life of the system. The normal process for hydrogen to diffuse through metal is in the form of atomic hydrogen that results from the breakup of H2 molecules during corrosion. However, once the hydrogen diffuses through the outer tube 70 the H2 molecules normally re-form and must once again dissociate to penetrate inner tube 68. Accordingly, the tube-in-tube structure provides a redundant hydrogen barrier. The structure also provides opportunities for the hydrogen to migrate to the surface and/or to be removed by circulating fluid through flow passages 86, 88 to flush hydrogen from the system.

Although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for deploying an optical fiber in a well environment, comprising:

a tubular well component;

a protection system deployed along the tubular well component, the protection system comprising an outer tube, an inner tube disposed within the outer tube, and a fluid turn around to enable flow between the inner tube and the outer tube;

a well head having a well head outlet coupled to the inner tube and the outer tube in a manner allowing the inner tube and the outer tube to pass through the well head while maintaining the pressure integrity of the well; and an optical fiber deployed along at least an interior of the inner tube.

2. The system as recited in claim 1, wherein the tubular well component comprises a well completion.

3. The system as recited in claim 1, wherein the tubular well component comprises a riser.

4. The system as recited in claim 1, wherein the tubular well component comprises a pipeline.

5. The system as recited in claim 1, wherein the protection system comprises a plurality of inner tubes deployed within the outer tube.

6. The system as recited in claim 1, wherein the protection system comprises a conduit splice positioned to splice the inner tube and the outer tube between the well head and the fluid turn around.

7. The system as recited in claim 1, wherein the protection system is deployed within the tubular well component.

8. The system as recited in claim 1, wherein the protection system is deployed along an exterior of the tubular well component.

9. The system as recited in claim 1, further comprising a junction box to enclose a splice between the optical fiber and a surface cable.

* * * * *